US006007411A

United States Patent [19]

Feeney

[11] Patent Number: 6,007,411

[45] Date of Patent: Dec. 28, 1999

[54] WAFER CARRIER FOR CHEMICAL MECHANICAL POLISHING

[75] Inventor: Paul M. Feeney, Richmond, Vt.

[73] Assignee: Interantional Business Machines Corporation, Armonk, N.Y.

[21] Appl. No.: 08/878,568

[22] Filed: Jun. 19, 1997

[51] Int. Cl.[6] ..... B24B 7/00

[52] U.S. Cl. ..... 451/285; 451/63; 451/41; 451/288; 451/285; 451/287; 156/345

[58] Field of Search ..... 156/345; 451/63, 451/41, 288, 285, 287

[56] References Cited

U.S. PATENT DOCUMENTS 4,323,422 4/1982 Calawa et al. .
4,940,507 7/1990 Harbarger .
5,040,336 8/1991 Ahern .
5,216,843 6/1993 Breivogel et al. .
5,394,655 3/1995 Allen et al. .
5,474,644 12/1995 Kato et al. .
5,486,265 1/1996 Salugsugan .
5,597,346 1/1997 Hempel, Jr. ..... 451/287

*Primary Examiner*—Bruce Breneman
*Assistant Examiner*—Norca L. Torres
*Attorney, Agent, or Firm*—Whitham, Curtis & Whitham; Alison D. Mortinger

[57] ABSTRACT

A wafer carrier for chemical mechanical polishing. The carrier has a notch where wafers are placed for polishing and a ledge around the notch. An outer rim extends from the ledge and, during polishing, below the polished wafer compressing a polishing pad therebelow. Slurry is provided to the polishing pad, during polishing, by slurry channels through the carrier into the ledge. Excess slurry exits through the pad or, optionally, through a plurality of exit channels through the rim.

17 Claims, 1 Drawing Sheet

WAFER CARRIER FOR CHEMICAL MECHANICAL POLISHING

RELATED APPLICATION

The present invention is related to U.S. patent application Ser. No. 08/878,567 (Attorney Docket No. FI9-97-037) entitled "A Wafer Carrier Assembly for Chem-Mech Polishing" to Fischer, Jr, et al., filed coincident herewith and assigned to the assignee of the present application.

BACKGROUND OF THE INVENTION

1. Field of the Invention

The Present invention is related to semiconductor chip manufacture and more particularly to wafer carriers for Chemical Mechanical Polishing.

2. Background Description

One typical use of Chemical Mechanical Polishing (CMP) in semiconductor manufacturing is for removing superficial topographical irregularities in a surface layer of a semiconductor wafer. However, the edge regions of the wafers polish faster than the center regions causing non-uniformity in the finished thickness of the polished film.

Uneven polishing occurs in CMP processes because the wafer being polished compresses the polishing pad, causing higher pressure at the edges of the wafer. That higher pressure also prevents even slurry distribution. Less slurry works towards the center of the wafer than is available at the edges. Compression rings for pre-compressing the pad may solve the edge pressure problem, but do not improve slurry distribution.

SUMMARY OF THE INVENTION

It is a purpose of the invention to improve Chemical Mechanical Polishing (CMP) uniformity;

It is another purpose of the present invention to improve CMP slurry distribution.

It is yet another purpose of the present invention to reduce polishing time.

The present invention is a wafer carrier for chemical mechanical polishing. The carrier has a notch where wafers are placed for polishing and a ledge around the notch. An outer rim extends from the ledge and, during polishing, above the polished wafer. Slurry is provided to a polishing pad during polishing by slurry channels through the carrier into the ledge. Excess slurry exits through the pad or, optionally, through a plurality of exit channels through the rim.

BRIEF DESCRIPTION OF THE DRAWINGS

The foregoing purposes and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
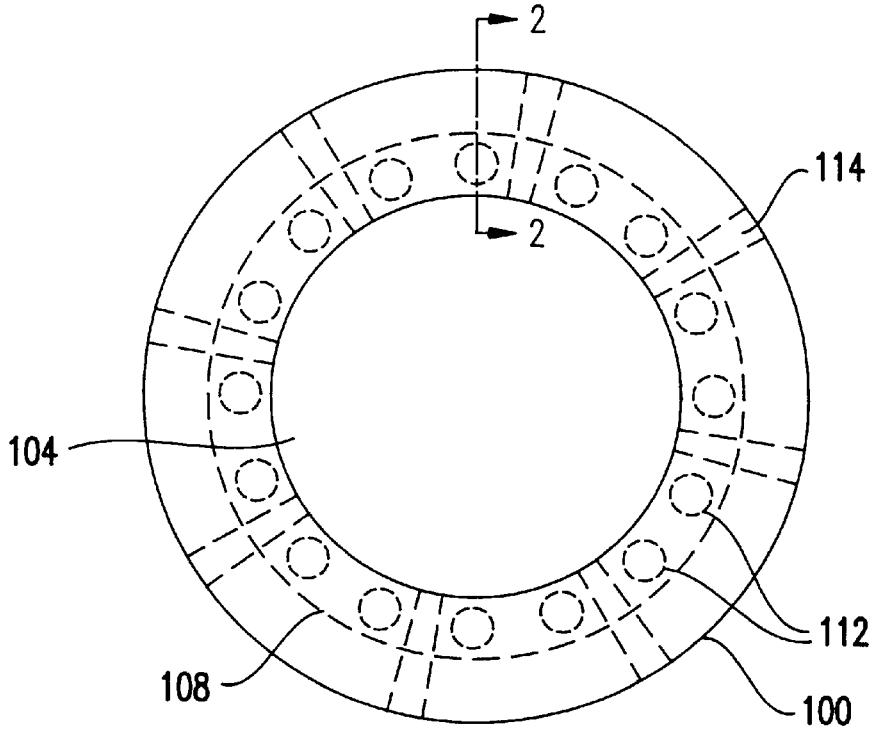
FIG. 1 is a top view of a preferred embodiment carrier.
Figure 2:
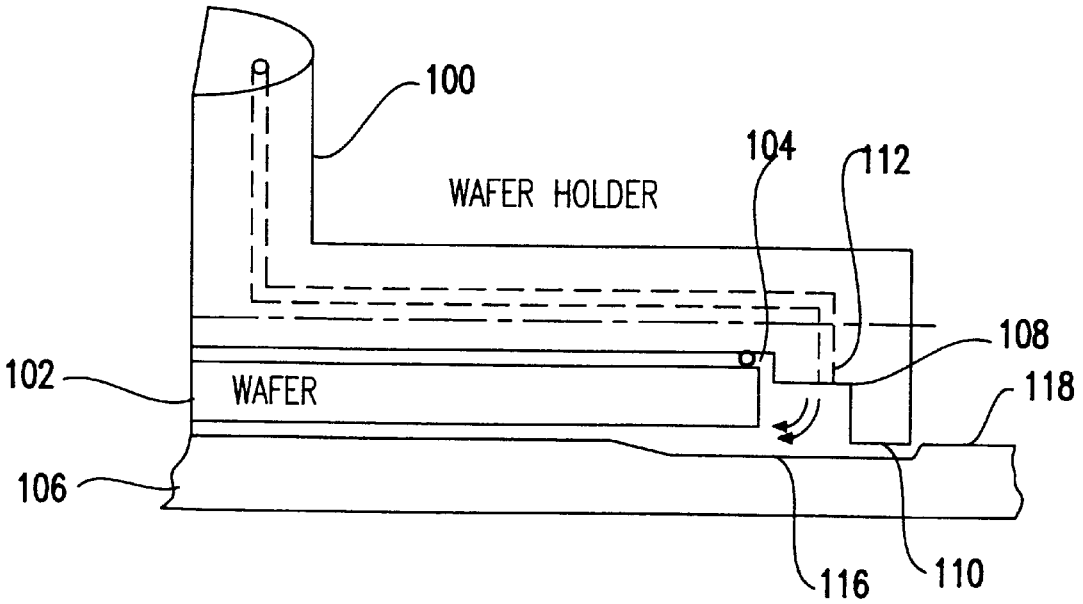
FIG. 2 is a cross-section of the assembly of FIG. 1 through 2—2.

FIG. 1 is a top view of a preferred embodiment wafer carrier 100. FIG. 2 is a cross section of the preferred embodiment wafer carrier 100 of FIG. 1 through 2—2. The wafer carrier 100 is shown with a wafer 102 being held in a notch 104. The wafer is held in the carrier 100 by a vacuum provided to the wafer 102 through orifices (not shown) in the notch 104. The carrier, with the wafer mounted thereon, is inverted and pressed against a pad 106 for polishing.

The preferred embodiment carrier 100 has a ledge 108 around the notch 104. The ledge 108 is, preferably, between 1–10 mm, and, most preferably, 2.5 mm. An outer rim 110 extends from the ledge 108, preferably, between 0.5–2.0 mm and, most preferably 1.0 mm. The rim 110 is between 5–40 mm wide, and, preferably, is 10 mm. Slurry is provided to the pad 106 during polishing by a plurality of slurry channels 112 that extend through the carrier 100 and open into the ledge 108. Slurry is provided to the pad 106 such that slurry fills the space on the pad 106, in the gap between the wafer 102 and the rim 110 (i.e. below ledge 108). Excess slurry exits through the pad or, optionally, through a plurality of exit channels 114.

The distance the rim 110 extends from the ledge 108 determines the thickness of wafers 102 that may be polished in any particular carrier 100. During polishing, the rim 110 presses into the pad 106, so that pressure is maintained on the pad 106 by the carrier 100. Therefore, wafer thickness is limited for a particular preferred embodiment carrier 100 to those wafers wherein the rim 110 extends beyond the surface of the wafer 102 in the notch 104. Preferably, the rim 110, extends beyond the wafer 104 by 1.0 mm. This guarantees that, during polishing, the rim 110 pressing into the polishing pad 106 with a force between 0–10 psi, forms a depression 116 in the pad's surface 118.

To insure that slurry is evenly distributed to the wafer, the depression 116 should extend laterally under the wafer's perimeter. Slurry, supplied through the slurry channels 112 fills the space between the depression 116 and the ledge 108 and helps to maintain the pressure on the pad 106. This pressure maintains the depression 116 in the pad 106 along the length of the ledge 108 and under the perimeter of the wafer 102. The exit channels 114 in the carrier 100 allow the escape of excess slurry, that might otherwise lift the carrier 100 off of the pad 106.

While the invention has been described in terms of preferred embodiments, those skilled in the art will recognize that the invention can be practiced with modification within the spirit and scope of the appended claims.

I claim:

1. A wafer carrier for holding a wafer during chemical mechanical polishing, said wafer carrier having a notch in one surface for carrying a wafer to be polished, said wafer carrier further comprising:

a ledge around said notch; and an outer rim extending from said ledge.

2. The wafer carrier of claim 1 further comprising a plurality of slurry channels in said wafer carrier openings into the ledge.

3. The wafer carrier of claim 1 further comprising a plurality of exit channels extending through said outer rim.

4. The wafer carrier of claim 1 wherein the rim extends from said ledge between 0.5–2.0 mm.

5. The wafer carrier of claim 4 wherein the rim extends from said ledge 1.0 mm.

6. The wafer carrier of claim 1 wherein the ledge is between 1–10 mm wide.

7. The wafer carrier of claim 6 wherein the ledge is 2.5 mm wide.

8. The wafer carrier of claim 1 wherein the rim is between 5–40 mm wide.

9. The wafer carrier of claim 8 wherein the rim is 10 mm wide.

10. A wafer carrier for holding a wafer during chemical mechanical polishing, said wafer carrier having a notch in one surface for carrying a wafer to be polished, said wafer carrier further comprising:

a ledge around said notch;

an outer rim extending from said ledge;

a plurality of slurry channels in said wafer carrier with openings in said ledge, whereby slurry being forced through said slurry channels fills space between a polishing pad polishing a wafer and said ledge, said slurry maintaining pressure applied to a polishing surface of said polishing pad by said outer rim; and a plurality of exit channels extending through said outer rim.

11. The wafer carrier of claim 10 wherein the rim extends between 0.5–2.0 mm from said ledge.

12. The wafer carrier of claim 11 wherein the rim extends 1 mm from said ledge.

13. The wafer carrier of claim 11 wherein the ledge is between 1–10 mm wide.

14. The wafer carrier of claim 13 wherein the ledge is 2.5 mm wide.

15. The wafer carrier of claim 13 wherein the rim is between 5–40 mm wide.

16. The wafer carrier of claim 15 wherein the rim is 10 mm wide.

17. A wafer carrier for holding a wafer during chemical mechanical polishing, said wafer carrier having a notch in one surface for carrying a wafer to be polished, said wafer carrier further comprising:

a 1–10 mm wide ledge around said notch;

a 5–40 mm wide outer rim extending 0.5–2.0 mm from said ledge;

a plurality of slurry channels in said wafer carrier with openings in said ledge, whereby slurry being forced through said slurry channels fills space between a polishing pad polishing a wafer and said ledge, said slurry maintaining pressure applied to a polishing surface of said polishing pad by said outer rim; and a plurality of exit channels through said outer rim.

* * * * *